United States Patent [19]

McCray

[11] 4,131,265

[45] Dec. 26, 1978

[54] SLAG POTS

[76] Inventor: Walter A. McCray, 20200 Sheldon Rd., Cleveland, Ohio 44142

[21] Appl. No.: 841,516

[22] Filed: Oct. 12, 1977

[30] Foreign Application Priority Data

Oct. 12, 1976 [GB] United Kingdom ..... 42355/76

[51] Int. Cl.[2] ..... F27D 15/00

[52] U.S. Cl. ..... 266/275

[58] Field of Search ..... 266/275–278

[56] References Cited

U.S. PATENT DOCUMENTS

| | | | |
|---|---|---|---|
| 781,293 | 1/1905 | McDonald | 266/275 |
| 2,143,557 | 1/1939 | Howat | 266/278 |
| 2,165,066 | 7/1939 | Needham et al. | 266/275 |
| 2,191,482 | 2/1940 | Hopkins | 164/52 |
| 2,198,252 | 4/1940 | Johnston | 266/278 |
| 2,205,940 | 6/1940 | Astrom | 266/276 |
| 2,294,044 | 8/1942 | Nielsen | 266/275 |
| 3,689,051 | 9/1972 | Miller | 266/275 |

*Primary Examiner*—Gerald A. Dost

*Attorney, Agent, or Firm*—Caesar, Rivise, Bernstein & Cohen, Ltd.

[57] ABSTRACT

Slag pots are formed of an upper section formed of a plurality of wall units secured together, e.g. by electro-slag welding and a lower floor portion engaged with the upper section, e.g. by a bolted joint. A trunnion ring may surround the upper portion to enable the pot to be lifted.

5 Claims, 4 Drawing Figures

Fig.3
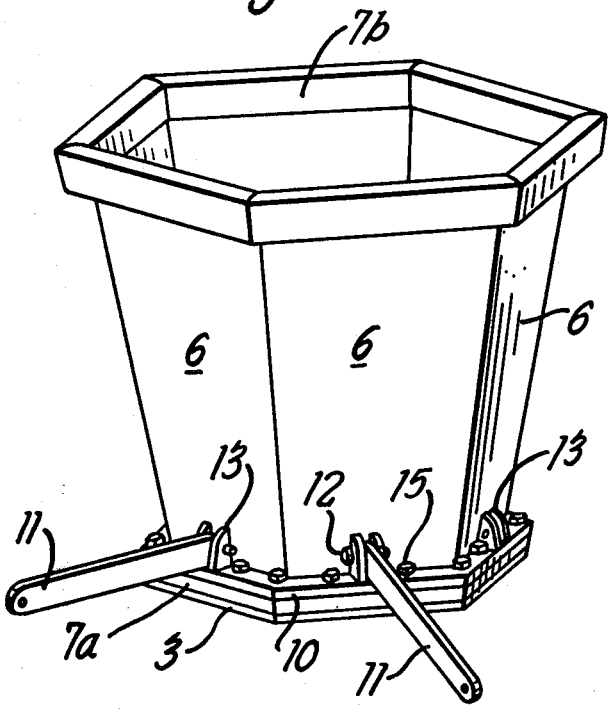
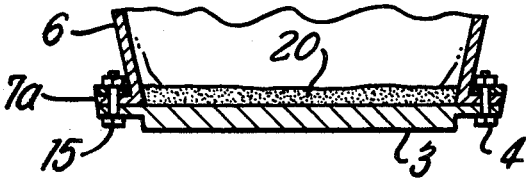
Fig.4

SLAG POTS

The invention relates to slag pots of the type used in association with basic oxygen furnaces in the steel industry. Typically such pots are cast vessels used to convey slag from the furnace to a dump. With time, the slag tends to adhere to the inside of the pot and the adherent material must be removed so that the pot can continue to be used economically. The removal may be done by banging the pot, e.g. with a swinging ball on a chain, and while this frees the pot of the slag it also tends to damage the pot itself. This can be especially serious where liquid metal has solidified in the pot along with the slag and much force is needed to remove the body of adherent slag and solidified metal which is known as skull. Because the pot has been formed as a casting it is difficult to make good all the damaged areas in an economical and reliable way. For this reason there has been a tendency to discard slag pots when only some portions of the pot are seriously damaged. However, the cost of the pots has risen to the point where this is no longer economic and so more patching is done even though this is costly.

Recently, there has also been a reluctance on the part of the foundries in certain countries to cast new slag pots and this has forced up the price of the cast pots. There has, as a result, been pressure to use old worn out pots with a lowering of efficiency.

This invention is based on the realization that if the slag pot is fabricated of a number of standardized units which are then interconnected in a releasable way then it will be possible to discard the worn parts while retaining serviceable parts and it will be generally easier, cheaper and quicker to make the pots.

According to a first feature of this invention there is provided a slag pot comprising an upper portion constituting sidewalls of the pot, a lower portion constituting a floor of the pot, and interengaging means by which the upper portion and the lower portion may be held together, the upper portion being formed of a plurality of wall units being secured together.

The upper portion is preferably constituted of wall units such as heavy steel plates (e.g. up to 10 cm thick) which are most preferably welded together by electroslag welding, which is a process of electric welding wherein a molten slag pool is formed between the members to be welded together and filler metal is then introduced into the slag pool. The metal sinks to the bottom of the pool and fills up the space between the members to be welded together. The molten slag, which offers a resistance to the flow of electric current, is heated by passing a current through it to a temperature great enough to cause fusion of the filler metal. A description of the method is given in Welding Processes and Technology, D. Romans & I. N. Simons, Pitman 1968, at pages 142–147, and see also U.S. Pat. Nos. 2,191,478 and 2,191,482. The use of this welding technique in this context of the present invention is of particular value as it enables the relatively cheap production from a plurality of individual wall units of an upper portion having adequate resistance to sudden thermal and/or mechanical shock of the type experienced by slag pots in use.

The upper portion may be formed in a wide variety of shapes, according to working conditions, design preference and the like; typically the upper portion will take the form of a truncated pyramid of hexagonal cross-section. The upper portion may also be of square or circular cross-sectional shape.

The lower portion of the pot will typically comprise a flat steel plate. The interengaging means by which the upper and lower portions of the slag pot are held together are preferably releasable. For example such a plate may have at its edges bolts (or sockets to receive bolts) whereby it may be held to the upper portion in a releasable manner. To secure the plate to the upper portion the latter may have an internal or external flange or ledge at its lower edge. When the slag has accumulated on the lower portion within the pot to the extent that it connot be removed economically by a standard technique, the bolts may be removed, if necessary by being burned away, so allowing the lower portion to be separated from the upper portion.

To release from the inside of the pot a particularly adherent body of slag and/or solidified metal, it is much preferred according to the invention to locate on such a steel plate a layer of refractory material in an area where slag is most likely to accumulate (usually the center). When the slag has built up, the edges of the steel plate may be burned away so exposing the aperture at the base of the pot through which a ram may be passed to force the remaining central portion of the plate and the whole of the slag/metal body out of the pot. The steel plate may then be replaced without banging the walls of the upper portion.

A slag pot is usually supported on trunnions; the slag pot of the invention preferably further includes a separate trunnion ring which detachably engages the upper portion of the pot. Such a ring may be of a suitable shape and have trunnions secured to its outside, e.g. by electroslag welding. Typically the ring and the pots are made to crude tolerances but by having a pot formed of subunits as in accordance with the invention, it is easier on site to fabricate the pot better to engage a trunnion ring of a particular shape or design. It is, of course, possible to make slag pots of the invention having trunnions fixed to the upper portion of the pot body.

When using slag pots according to the present invention, their life may be further prolonged by the use of techniques known for protecting the insides of molten metal handling vessels. Thus, the interior of the slag pot may be lined with an expendable or disposable liner of one or a plurality of slabs of refractory material, usually of a heat-insulating type. After use, such a lining is simply removed and replaced. The centre of the floor of the slag pot, which is particularly liable to erosion when slag is first poured into the pot, may have a highly refractory brick, plate or tile set in it; such bricks, plates and tiles are known for analogous purposes in ingot mould base plates. Also, the interior of the pot, including any lining or insert in the base if used, may be sprayed prior to use with a refractory dressing.

An embodiment of the invention will now be described, by way of illustration only, with reference to the accompanying diagrammatic drawings, in which:

FIG. 3 is a side elevation as in FIG. 1 with the detachable trunnion ring removed, and FIG. 4 is a cross-section view of a detail of the slag pot shown in FIG. 1.

Figure 1:
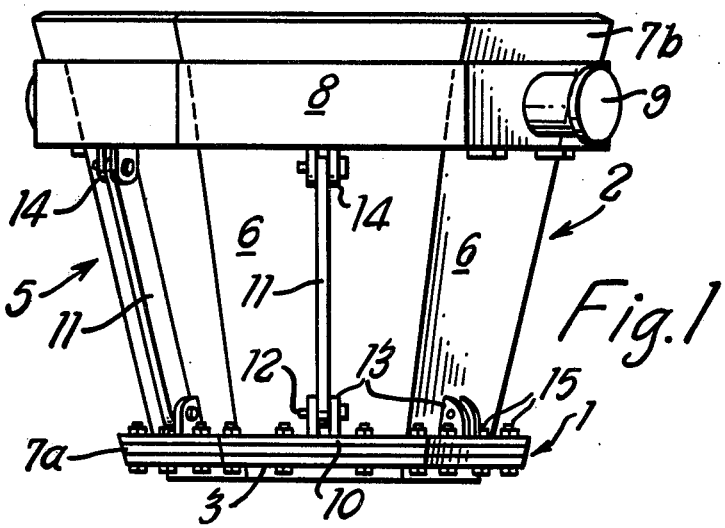
FIG. 1 is a side elevation of a slag pot according to the present invention.

Referring to the drawings, the slag pot comprises a lower portion 1, an upper portion 2, and a detachable trunnion ring 8.

Figure 2:
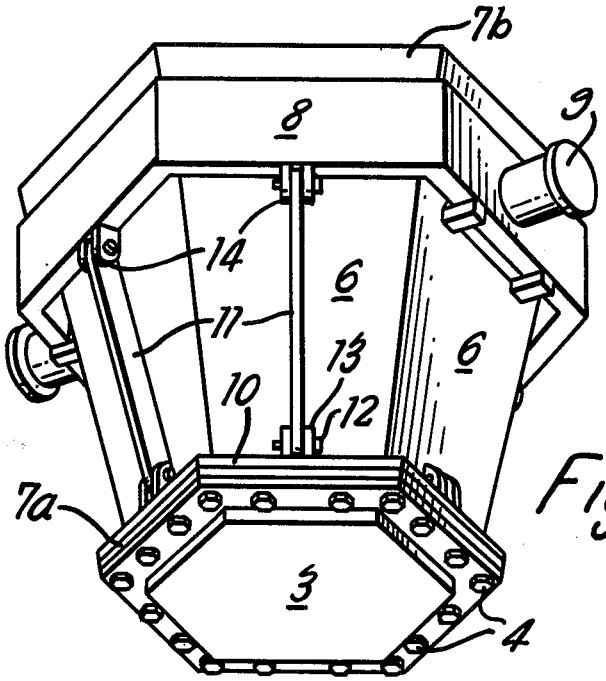
FIG. 2 is a perspective view taken of the slag pot of FIG. 1 taken from below.

The lower portion 1 of the pot body is a flat steel plate 3 of hexagonal shape, best seen in FIG. 2, having a row of bolt holes 4 arranged adjacent to the edge of the plate.

The upper portion 2 of the pot body comprises a truncated pyramid body 5 of hexagonal cross-sectional shape formed by electroslag welding together of six individual suitably shaped wall units 6. Each of the wall units 6 has an out-turned lip *7a* at its lower end, the lip having bolt holes to register with holes 4 of the steel plate 3. An out-turned lip *7b* is also formed at the upper end of each wall unit 6. Generally the wall units 6 will be made of heavy steel plates e.g. 10 cm thick. The electroslag welding technique used to weld together the fabricated wall units 6 may be performed according to the disclosures of U.S. Pat. Nos. 2,191,278 and 2,191,482, all of which are incorporated herein by this reference.

A separate trunnion ring 8 of hexagonal shape is dimensioned to fit on the exterior of the upper portion 2 adjacent the upper edge by abutting the underside of the lip *7b*. The ring 8 carries a pair of opposite trunnions 9 made of heavy wall pipe or solid round or square or forging bar. The trunnions 9 may be secured to the ring 8 by electroslag welding. A hinge ring 10 is secured at the lower end of the upper portion 2 of the slag pot on top of the lip *7a* of the wall units 6.

The hinge ring 10 has bolt holes aligned with holes 4 of the flat steel plate 3 and the holes in lip *7a*. Hinge rods 11 extend between the underside of the trunnion ring 8 and the ring 10 to hold the trunnion ring to the pot. The rods have holes at each end and are secured by split pins 12 passed through side supports 13, 14 respectively mounted on the hinge ring 10 and the trunnion ring 8.

To assemble the slag pot body the upper portion 2 is fabricated from individual wall units 6, which are assembled together within hinge ring 10 and thereafter joined together easily and cheaply by electroslag welding. The upper portion 2 is then located on the flat steel plate 3 with the respective bolt holes in registry. Bolts 15 are then passed through holes 4 and nuts engaged on the bolts to hold hinge ring 10, the upper portion 2 and the lower portion 1 together. Hinged rods 11 are then fixed by pins 12 in supports 13.

The assembly is then lifted and lowered into the preformed trunnion ring 8, suitably held above a surface by means of trunnions 9, and the hinged rods 11 then engaged with the supports 14 to lock the trunnion ring 8 to the pot.

The slag pot may then be used in the customary way, slag adhering to the inner surface of the flat steel plate 3 being removed in the usual way. When the slag cannot be removed economically, the trunnion ring 8 is removed by removing the bolts 15 holding the lower and upper portions together. The lower portion may then be discarded and a fresh steel plate 3 bolted to the old upper portion 2 which still has a useful life.

FIG. 4 shows the presence of a rammed layer of refractory material 20 on top of the inner surface of the flat steel plate 3 to minimize adhesion of the slag and skull to the slag pot. When so much slag has built up that plate 3 needs to be replaced, the bolts 15 and the adjacent portion of the plate 3 can be burned away and a hydraulic ram (not shown) can then be used to drive the slag-laden plate 3 through the upper portion 2 for discarding. A fresh flat steel plate 3 can then be secured to the upper portion 2 which may still have a useful life.

As shown by the above description, a slag pot of the invention will have a prolonged useful life and when any particular part of the pot is worn beyond reasonable economic repair it may be replaced without the need to discard the other serviceable parts of the pot.

Without further elaboration, the foregoing will so fully illustrate my invention that others may, by applying current or future knowledge, readily adapt the same for use under various conditions of service.

What is claimed as the invention is:

1. A slag pot comprising an upper portion formed of a plurality of metal plates welded together, constituting sidewalls of the pot and a lower portion floor of the pot secured to said sidewalls, lower out-turned lips extending from the lower edge of at least certain of said plates, said lips each having openings to permit the passage of bolts through said openings and corresponding openings in said floor in order to secure said floor to said sidewalls using bolts, upper out-turned lips extending from upper edges of at least certain of said plates, a trunnion ring of a shape dimensioned to fit about the upper edges of said plates, said trunnion ring carrying at least one pair of opposite trunnions, upper side supports mounted on said trunnion ring and lower side supports extending from said lower out-turned lips, hinged rods each secured to one of said upper and lower side supports to secure said trunnion ring whereby said trunnion ring may be removed by the separation of said bolts from said floor such that said floor may be replaced with a new floor by again securing said bolts in place.

2. The slag pot of claim 1 wherein the upper portion is formed of a plurality of metal plates welded together by electroslag welding.

3. The slag pot of claim 1 wherein the interengaging means is a bolted joint.

4. The slag pot of claim 1 wherein the floor of the pot is covered by a layer of a refractory composition.

5. The slag pot of claim 1 including a hinge ring secured to said lower out-turned lips and wherein said lower side supports are mounted on said hinge ring with said hinged rods securing the trunnion ring to the hinge ring.

* * * * *